United States Patent [19]

Parker

[11] 4,364,655

[45] Dec. 21, 1982

[54] PHOTOGRAPHIC DARKROOM CONTROL SYSTEM WITH TIMING MEANS

[76] Inventor: Russell A. Parker, 162 Locust St., Holliston, Mass. 01746

[21] Appl. No.: 236,055

[22] Filed: Feb. 19, 1981

[51] Int. Cl.[3] ..... G03D 3/00; G03D 3/02

[52] U.S. Cl. ..... 354/299; 354/327; 354/328; 355/67; 340/309.4; 307/141

[58] Field of Search ..... 354/297, 299, 327, 328; 355/27, 35, 36, 37, 38, 67, 68, 69, 77; 340/309.1, 309.4; 307/141, 141.4

[56] References Cited

U.S. PATENT DOCUMENTS

| | | | |
|---|---|---|---|
| 3,989,374 | 11/1976 | Latka et al. | 355/69 |
| 4,001,599 | 1/1977 | Karklys | 307/141 |
| 4,223,379 | 9/1980 | Simcoe | 307/141.4 |
| 4,318,084 | 3/1982 | Scott et al. | 340/309.1 |

*Primary Examiner*—L. T. Hix
*Assistant Examiner*—Alan Mathews
*Attorney, Agent, or Firm*—Jerry Cohen

[57] ABSTRACT

Process timing and controlling system for use in photographic darkrooms involving multiple timing and control process steps including a control console, programmable in at least one channel to step through substantially all timing and control process steps, timing means in at least one channel for measuring time remaining in a particular process step, timing indicator means in at least one channel for indicating time remaining in a particular process step, a source of power connecting the console and the timing means which when activated supplies power to the console and timing mean, means for initiating a program step in at least one channel, switching means in at least one channel for stepping through the steps independently of the programmed time, a plurality of relays for operating programmed timing and control functions, and relay driving means programmed to select an appropriate output to activate the relay.

30 Claims, 3 Drawing Figures

PHOTOGRAPHIC DARKROOM CONTROL SYSTEM WITH TIMING MEANS

BACKGROUND OF THE INVENTION

This invention relates to a process timing and controlling system for use in photographic darkrooms involving multiple timing and control process steps. Photographic darkroom procedure typically involves a combination of automated and manual processes. On the one hand, automatic timing is desired for uniform exposure enlargement, developing and agitation steps. For this purpose a variety of darkroom timers have been developed which may be programmed to measure and indicate the time remaining in each process step.

On the other hand, operator intervention is a prime feature of darkroom procedure. The worker must manually transfer a negative or print to and from the enlarger or between the various baths. Transfer times vary and are not easily monitored. Further, the operator may wish to extend or abbreviate the various process steps in order to produce a particular contrast or other print quality.

Present darkroom timers and process controllers lack the flexibility required because of operator intervention in the darkroom. Once programmed time is set, it cannot be altered without entirely reprogramming the timer. This may result in great inconvenience. Time is wasted. The reduced lighting of the darkroom hinders using a full keyboard to modify the program. Erroneous key entries are likely to result.

The operator's constant moving around the darkroom to various operating positions also creates problems. At present, means for remotely controlling darkroom process timing and controlling programs as well as remotely displaying the time remaining in each step are lacking. These features would permit the operator control over the timing and controlling of darkroom processes at remote sites.

Additionally, present systems are programmable in one channel only. A multiple channel system would permit even greater flexibility. For example, the "wet" processes could be programmed entirely separately from the "dry" steps.

Present use of relays in the darkroom is also inconvenient. Normally a relay box is plugged into a wall outlet and the appliance to be controlled is plugged into the relay. This is wasteful of the wall plug (1-to-2 or 1-to-3 adapters are necessary to re-plug in non-switched devices), the cord to the appliance may need an extension, and with several relay boxes connected, there may be an immediate shortage of outlets and extensions.

SUMMARY OF THE INVENTION

It is therefore an object of this invention to provide an improved process timing and controlling device for use in photographic darkrooms involving multiple timing and control process steps which is adaptable to an individual operator's particular needs.

It is a further object of this invention to provide a process timing and controlling device for use in photographic darkrooms involving multiple timing and control process steps which steps through timing or control function steps either automatically or manually and which provides ready means for operator intervention at both console and remote locations during stepping.

It is a further object of this invention to provide the aforementioned device which clearly indicates step times and is programmable at remote locations.

It is a further object of this invention to provide the aforementioned device which is programmable in multiple channels.

It is a further object of this invention to provide the aforementioned device which includes relays directly connected to increase the number of outlets and extensions available.

This invention features a process timing and controlling device for use in photographic darkrooms involving multiple timing and control process steps. Included is a control console, programmable in at least one channel to step through substantially all timing and control process steps. There are timing means in at least one channel for measuring time remaining in a particular process step. There are timing indicator means in at least one channel for indicating time remaining in a particular process step. Means defining a power relay box connect a source of power with the console and timing means and when activated supply power to the console and timing means. Means are included for initiating a program step in at least one channel. Switching means in at least one channel permit stepping through said steps independent of the programmed time. A plurality of relays operates programmed timing and control functions and relay driving means are included to select an appropriate output to activate the relays.

In a preferred embodiment the timing indicator means may include visual display means and/or an audio signal and may be remotely connected to the console. Step indicator means, such as a visual indicator may be included to indicate the program step currently in progress. The means for initiating may include at least one push-button switch. Likewise the switching means for stepping may include at least one push-button switch. The same switch may serve as both means for initiating and means for stepping. Said means for initiating and/or said switching means for stepping may be remotely connected with said console. A temperature regulating mechanism may be included in at least one channel, having a relay activated heater which is operated either manually or automatically to control solution temperature. A thermometer for measuring temperature in at least one channel may be included and further may be included with the temperature regulating mechanism in a single probe. Burst agitators may be included in at least one channel to release a burst of gas into solutions at programmed intervals. The burst agitators may include burst timing means which are calibrated for the interval independently of the console. Tray rockers may be included in at least one channel to rock solutions at programmed intervals. Audio agitation reminders may be included which sound at programmed intervals. A photometric accessory may be included for measuring negative density. The relays may be directly connected.

Other objects, features and advantages will occur from the following description of preferred embodiments, made with reference to the accompanying drawings in which:

DETAILED DESCRIPTION OF PREFERRED EMBODIMENTS

Figure 1:
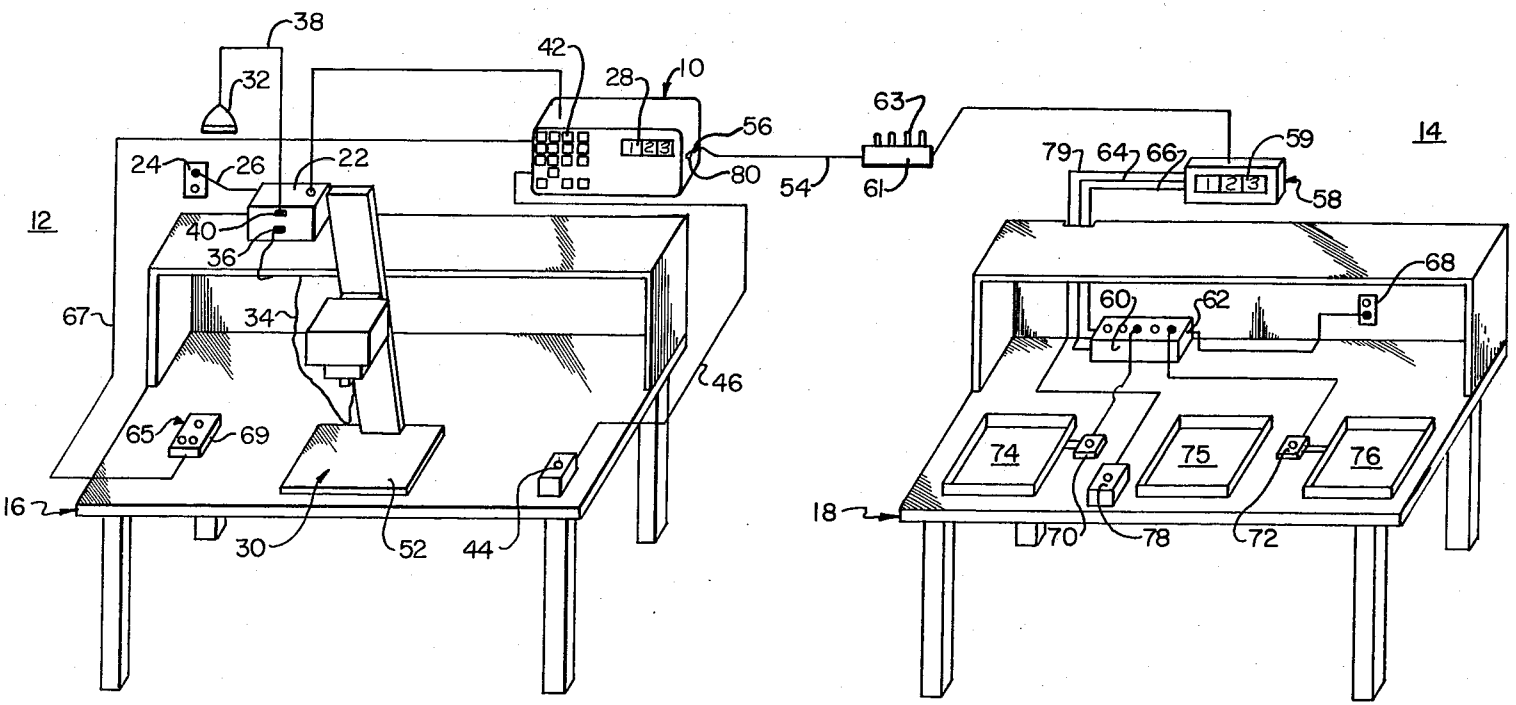
FIG. 1 is a plan view of a process timing and controlling device according to this invention which is set up to handle "dry" darkroom processes in a first channel and "wet" darkroom processes in a second channel at a remote location.

A process timing and controlling device for use in photographic darkrooms, according to this invention may be effected using a control console easily and reliably accessed by the darkroom operator which is adequate for all necessary timing and control functions. Additional consoles may be added to permit remote programming or program modification. A power relay box supplies power from a standard outlet to the non-remote console. The console is programmable in typically two channels. Dry processes, such as enlarging may be monitored in a first channel while wet processes, such as developing and other baths are monitored in a second channel. In alternative embodiments both types of processes may be programmed in the same channel and multiple remote locations of either type of process may be monitored in either one or both channels. It is also practical to have multiple remote locations divided along lines other than "wet" versus "dry" step allocation.

Timing means powered by the power relay box may be included in the console and are programmed to time each process step. Audio and visual timing indicator means are included, both with the console and at desired remote locations to provide the operator with adequate and convenient monitoring. The visual indicator may include a digital display or any alternative timing indicator. The timing means may be programmed from 0.1 to 99.9 seconds with a display resolution of 0.1 second or they may time from 1 to 999 seconds and display the time remaining in whole seconds. Alternatively, for long steps the timing device may time from 0.1 to 99.9 minutes with a resolution of 6 seconds. The audio indicator may include an internal buzzer or "beeper" which sounds at programmed intervals.

Means for initiating the running of a program in each channel may include switching means. At the end of a programmed time or control function the program may automatically advance to the next step. Alternatively, switching means, preferably including the same switching means as the means for initiating, allow for manual stepping (including advancing and resetting) of the program. The combined initiating-stepping switching means typically include a push-button switch although alternative switches are acceptable. A single-pole, single-throw contact closure is preferred. The switch should be of high quality to immunize contact bounce. An abbreviated push (for example, less than 0.3 seconds) advances the program one step. An extended push (0.3 seconds or more) resets the program to its initial step. A further push of the switch indicates the running of either the advanced step or initial step. In this manner the operator may extend or shorten exposure and development times, skip processes and otherwise alternate his procedure. Further, any number of initiation and stepping switches means may be included at remote locations to provide ready darkroom access.

To operate timing and controlling functioning remote relays are included to supplement the power relay. The power relay may include normally opened and normally closed switched outlets to which devices such as enlargers or safelights may be connected. At each program step a multi (usually 16) channel relay driver selects an appropriate output and activates a selected relay which in turn performs a darkroom timing or control function.

The remote relays may be made stackable (i.e. each directly connected to a neighboring relay). With every remote relay, there are the normally opened/normally closed switched outputs plus two non-switched outlets. One non-switched outlet of each relay provides input power to the relays connected thereto. The other non-switched outlet may be used for other purposes. For an installation of three remote relays, one wall socket is used, generating four more sockets at the remote relay location.

Darkroom agitation may be performed in several manners. A relay may activate a burst timer which at selected intervals will activate a burst agitator to release a burst of gas into various solutions in order to agitate them. The selected intervals may be calibrated independently of the console. Where color photography is involved, tray rockers may be activated at programmed intervals. Alternatively, manual agitation may be desired and accordingly a buzzer or alternative audio reminder may be included to sound intermittently (for example for 12 seconds every thirty seconds or minute) to remind the operator of this task.

Temperature monitoring and regulating devices may be included in at least one channel and are typically included in a single probe, preferably composed of stainless steel. The probe is immersed in a water bath or other solution and records the temperature, displaying it on both the console and/or remote visual displays. To regulate temperature the device is calibrated as desired between 65° F.–110° F. When the probe senses deviation from the desired temperature a relay is closed or opened, either manually or automatically, thus actuating or deactivating a heater to maintain the desired temperature.

An exposure meter may be included which measures the negative density of the negative which the operator desires to enlarge. The meter is calibrated for a desired exposure development combination and provides a reading which is displayed on the console and/or remote visual displays enabling the operator to adjust his exposure time and/or aperture opening to obtain consistently exposed enlargements.

Console 10, FIG. 1, is programmable to perform all timing and control functions in channels 12 and 14. Channel 12 is programmed to monitor "dry" processes, such as enlarging, on table 16 whereas channel 14 is programmed to handle the "wet" processes such as developing on table 18.

Power relay 22, connected to a standard outlet 24, via line 26, supplies power to console 10, a timer within console 10, and visual display 28 and acts as a relay to drive enlarger 30 and safelight 32. Enlarger 30 is connected via line 34 to normally open (NO) switched outlet 36 while safelight 32 is connected via line 38 to normally closed (NC) switched outlet 40. An obscured relay driver in console 10 is activated on each step in channel 12 to operate relay box 22 and thus open and close outlets 36 and 40.

Keyboard 42 enters the desired steps in channel 12 (as well as channel 14). The steps are then initiated by pushing push-button switch 44 is connected via line 46 to console 10 at an obscured channel 12 input jack. Obscured timing means in console 10 commences counting down the time remaining in each programmed step. Such time is displayed on visual display 28. An internal audio signal such as an obscured buzzer in console 10 sounds at programmed intervals.

As each step times out, the program will automatically advance one step (provided additional steps remain). Alternatively a further push of button 44, for an abbreviated time, immediately interrupts the step in process and advances the program to the next step. A third push of button 44 commences the new step. If button 44 is pushed for an extended time the program will reset to its initial step.

Typically in channel 12 enlarger focussing is an initial step. To perform this task the darkroom worker pushes button 44 for an extended period of time (note: if the NO enlarger outlet 36 is closed at the start of this procedure button 44 must be pushed twice). This initializes the program in channel 12 and closed NO outlet 36 thus turning on enlarger 30. As no time is normally entered for the focussing step, enlarger 30 remains on for any period of time required for the operator to focus it satisfactorily. A further push of button 44 opens NO outlet 36 and closes NC outlet 40 thus activating safelight 32 and deactivating enlarger 30. This permits placement of print paper on enlarger base 52. A further push of button 44 commences the next step (typically enlarging for a programmed time).

Referring to channel 14, line 54 connects to console 10 at channel 14 input jack 56. Remote display and controlling device 58 displays on display 59 the time remaining in the step currently in progress. An obscured multichannel relay driver in device 58 selects an output corresponding to the current program step in channel 14 and activates relays 60 or 62, connected via lines 64 and 66, to provide voltage from outlet 68 for operating tray rockers 70 and 72. Trays 74 and 76 and the solutions within are thus agitated at programmed intervals (note that tray 75 includes no rocker and is thus not agitated). Push-button switch 78, connected to device 58 via line 79, allows manual interruption, advance and resetting of the rocking and timing steps in channel 14 in a manner analogous to button 44 in channel 12.

A special input jack 80, situated adjacent jack 56 and a special obscured jack adjacent the obscured channel 12 input jack are included to permit the inclusion of just an enlarger in each channel. The two special jacks correspond to two memory locations which are not programmed with the keyboard but instead are edited to contain desired enlarger times.

Device 58 includes an obscured internal audio signal which sounds at programmed intervals if switch 57 is activated. The internal audio signals of both the console 10 and device 58 may be utilized as an agitation reminder to sound for an extended period at programmed intervals.

Step indicator means 61 includes four lights 63 which alternatively light upon each step of a program in channel 14. (Note that indicator 61 is includable in either channel.)

Photometric device 65 is connected to console 10 via line 67 and utilizes display 28 and remote display 59. Engaging switch 69 transfers the displays into a photometric mode. Device 65 is calibrated for an "ideal" negative and any deviation from this reading appears on displays 28 and 59 thus allowing the operator to adjust the exposure or development time on the enlarger aperture.

Figure 2:
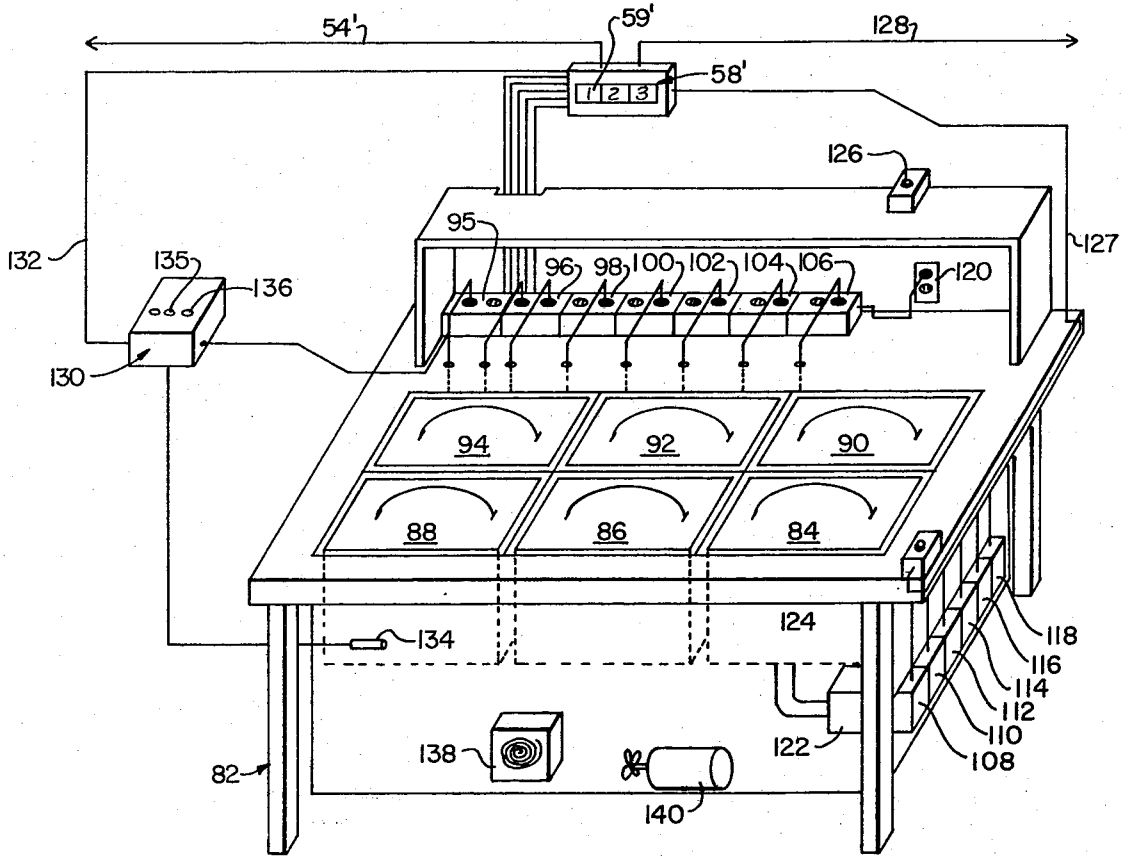
FIG. 2 is a plan view of various components of the process timing and controlling device of this invention situated at a typical "wet" process remote location.

A typical remote bench 82 in either channel, is illustrated in FIG. 2. Remote display and controlling device 58' including display 59' is connected via line 54' to console 10 (see FIG. 1). Display 59' conveniently indicates the time remaining in the current process step. Tanks 84, 86, 88, 90, 92, 94 contain the solutions used in, for example, slide and negative developing. A line of stackably connected relays 96, 98, 100, 102, 104, 106 are connected to device 58' and into each relay is plugged one of the burst timers 108, 110, 112, 114, 116, 118. At programmed intervals an obscured relay driver within device 58' activates a relay (for example, relay 96) corresponding to a particular process. Activation of relay 96 provides voltage from outlet 120 to the corresponding burst timer 108. Burst timer 110 is independently programmed to activate a burst agitator 122 at particular intervals (note that each burst timer has such an agitator) and agitator 122 consequently releases gas into tank 84 thus performing the necessary agitation function. Remote switches 124 and 126 connected via line 127 are located at convenient positions and operate identically to switches 44 and 78 of FIG. 1 to allow manual starting, stopping, advancing and resetting of the steps being performed on bench 82. Line 128 leads to further remote locations.

Also included with remote bench 82 is a temperature sensing and controlling device 130 which is connected via line 132 to visual display 59. When temperature control is desired, switch 135 is closed to activate a relay driver 130 for the heating means. Probe 134, FIG. 2, is immersed in a solution or wter bath in tank 88. Device 130 is then set for a desired temperature typically 85° to 105° F. Pushing button 136 will display the temperature on visual display 28 and on display 59' of remote display and controlling device 58'. When probe 134 senses that the actual temperature varies from the calibrated temperature, relay 95 is operated automatically by the aforementioned relay driver to close or open a standard voltage outlet 120 to activate or deactivate heater 138 and fan 140 thus maintaining the desired temperature.

Figure 3:
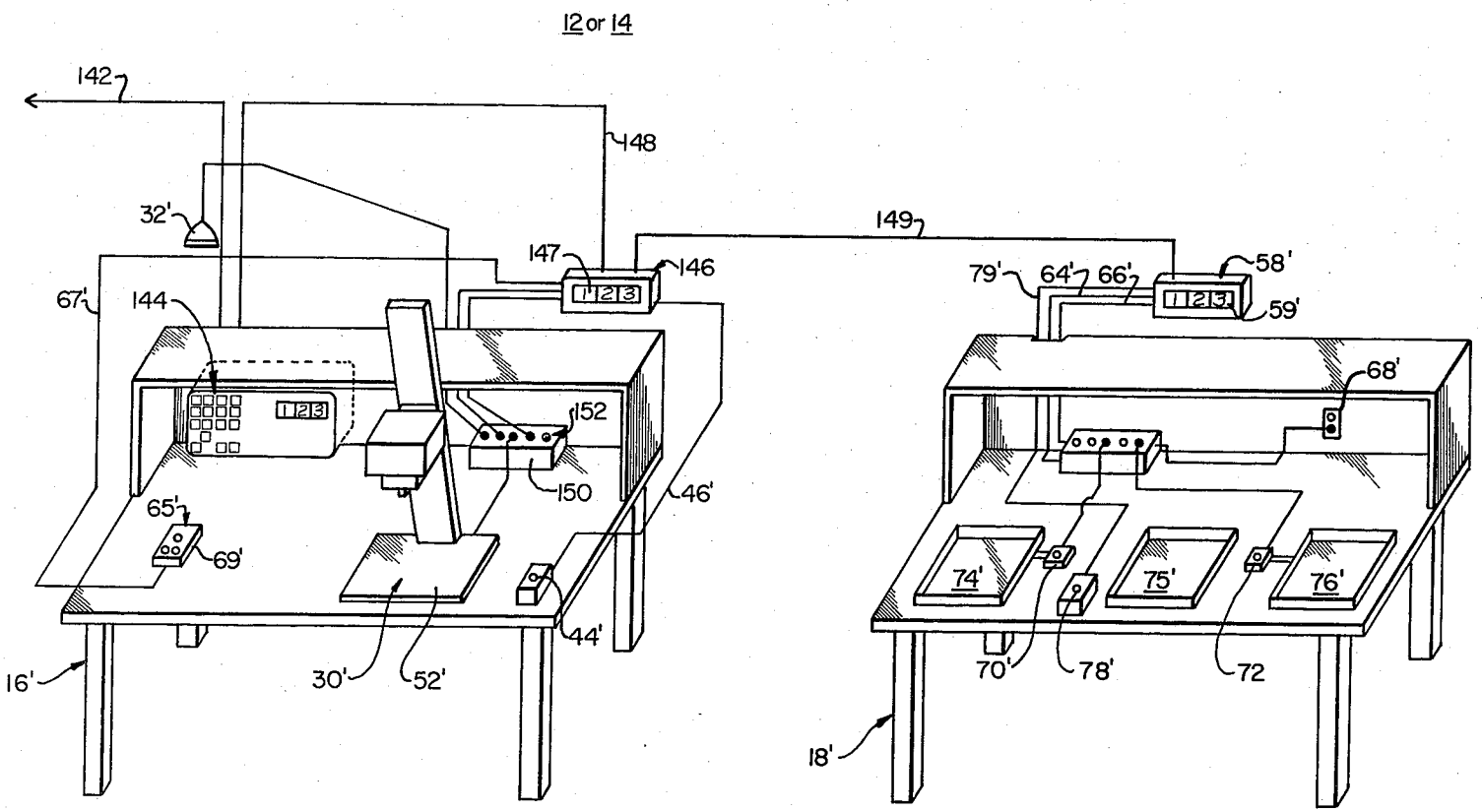
FIG. 3 is a plan view of an alternative embodiment to FIG. 1 of the timing and controlling device of this invention with both "wet" and "dry" processes handled in a single channel and at remote locations.

In an alternative embodiment of this invention, FIG. 3, dry tables 16' and 18' may be included in the same channel, either 12 or 14, FIG. 1. Both tables in FIG. 3 are at remote locations. Line 142 is connected to the unpictured console 10 as shown in FIG. 1. Remote console 144, FIG. 3, is included on table 16' to allow remote programming. Remote display and controlling device 146, connected to remote console via line 148 includes an obscured relay driver. Line 149 connects the two tables. Device 146 and directly connected relays 150 and 152 act analogous to console 10 and power relay 22 of FIG. 1 to operate safelight 32' and enlarger 30'. Note likewise that photometric device 65' is connected to device 146 and its measurements are displayed on display 147. All other arts in FIG. 3 operate similarly to similar FIG. 1 parts and are designated by the prime number designations of the corresponding FIG. 1 parts.

This invention may include an immeasurable variety of alternative combinations of tables and components in addition to those illustrated in FIGS. 1, 2 and 3. Such combinations are arranged to fit the needs of the particular darkroom or darkroom worker.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A process timing and controlling device system for use in photographic darkrooms involving multiple timing and control process steps comprising, a control console, programmable in at least on channel to automatically run and step through substantially all timing and control process steps, step timing means in at least one channel for counting down time remaining in a particular process step, step timing indicator means in at least one channel for indicating time remaining in a particular process step, means defining a power supply connecting a source of power with said console and said timing means which when activated supplies power to said console and timing means, means for initiating a program step in at least one channel, switching means in at least one channel for manually stepping through steps independently of the programmed time including means for interrupting a programmed timing step during automatic running thereof and means for advancing from the interrupted timing step to the subsequent program step, a plurality of relays for operating programmed timing and control functions, and relay driving means programmed to select an appropriate output to activate each said relay.

2. The device system of claim 1 in which said timing indicator means includes visual display means.

3. The device system of claim 1 in which said timing indicator means includes an audio signal.

4. The device system of claim 1 further including step indicator means for indicating the program step currently in progress.

5. The device system of claim 4 in which said step indicator means is visual.

6. The device system of claim 1 in which said means for initiating includes switching means.

7. The device system of claim 6 in which said initiating switching means includes at least one push-button switch.

8. The device system of claim 1 in which said switching means for stepping includes at least one push-button switch.

9. The device system of claim 6 in which said initiating switching means and switching means for stepping include the same switching means.

10. The device of claim 1 further including a temperature regulating mechanism, in at least one channel, having a relay actuated heater which is operated automatically to control solution temperature within narrowly defined upper and lower limits.

11. The device system of claim 1 further including a thermometer for measuring photographic darkroom solution temperature in at least one channel.

12. The device system of claim 11 further including a thermometer for measuring photographic darkroom solution temperature in at least one channel and in which said temperature regulating mechanism and said thermometer are included in a single probe.

13. The device system of claim 1 further including burst agitators which release a burst of gas into solutions in at least one channel at programmed intervals.

14. The device system of claim 13 in which said burst agitators include burst timing means which are calibrated for said intervals independently of said console.

15. The device system of claim 1 further including tray rockers in at least one channel which rock solutions at programmed intervals.

16. The device system of claim 1 further including audio agitation reminders which sound at programmed intervals.

17. The device system of claim 1 further including a photometric accessory for measuring negative density.

18. The device system of claim 1 in which said relays may be stackably connected.

19. The device system of claim 1 in which said switching means for stepping are remotely connected to said console.

20. The device system of claim 1 in which said initiating means are remotely connected to said console.

21. The device system of claim 1 in which said step timing indicator means are remotely connected to said console.

22. The device system of claim 2 further including a thermometer for measuring photographic darkroom solution temperature in at least one channel and in which said visual display indicates measurements taken by said thermometer.

23. The device system of claim 2 further including a photometric accessory for measuring negative density and in which said visual display indicates measurements taken by said photometric accessory.

24. The device system of claim 1 in which said power supply is associated with at least one said relay in a power relay box.

25. The device system of claim 1 in which said switching means further including means for initializing a program entered into said control console to the commencement of the first program step thereof.

26. The device system of claim 1 further including at least one auxiliary control console remotely connected to said control console and programmable in at least one channel to automatically run and step through substantially all timing and control process steps.

27. The device system of claim 1 in which said relays are remotely connected to said console.

28. The device system of claim 1 in which said control console includes multiple selector means for enabling variable selection and programming of a particular program step.

29. The device system of claim 12 in which said control console includes multiple selector means for enabling variable selection and programming of a particular program step and variable selection and programming of a controlled solution temperature.

30. The device system of either of claims 28 or 29 in which said multiple selector means comprise a keyboard.

* * * * *